US010593144B2

(12) United States Patent
Neuhauser

(10) Patent No.: US 10,593,144 B2
(45) Date of Patent: Mar. 17, 2020

(54) METHOD AND SYSTEM FOR PROCESSING VALUE DOCUMENTS

(71) Applicant: GIESECKE & DEVRIENT GMBH, München (DE)

(72) Inventor: Richard Neuhauser, München (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 15/117,776

(22) PCT Filed: Feb. 9, 2015

(86) PCT No.: PCT/EP2015/000332
§ 371 (c)(1),
(2) Date: Aug. 10, 2016

(87) PCT Pub. No.: WO2015/117770
PCT Pub. Date: Aug. 13, 2015

(65) Prior Publication Data

US 2016/0364937 A1 Dec. 15, 2016

(30) Foreign Application Priority Data

Feb. 10, 2014 (DE) ..... 10 2014 001 760

(51) Int. Cl.
*G07D 11/30* (2019.01)
*G07D 11/32* (2019.01)
(Continued)

(52) U.S. Cl.
CPC ..... *G07D 11/50* (2019.01); *B42D 25/29* (2014.10); *G07D 11/235* (2019.01);
(Continued)

(58) Field of Classification Search
CPC ..... G07D 11/0051; G07D 11/0054; G07D 11/006; G07D 11/0063; G07D 11/0066;
(Continued)

(56) References Cited

U.S. PATENT DOCUMENTS 6,407,522 B1 6/2002 Andersson et al.
8,556,254 B2 10/2013 Sakoguchi et al.
(Continued)

FOREIGN PATENT DOCUMENTS

CN 101019156 A 8/2007
CN 102576480 A 7/2012
(Continued)

OTHER PUBLICATIONS

German Search Report for corresponding German Application No. 102014001760.5, dated Nov. 27, 2014.
(Continued)

*Primary Examiner* — Jeffrey A Shapiro
(74) *Attorney, Agent, or Firm* — Workman Nydegger

(57) ABSTRACT

A method and a corresponding system for processing value documents, in particular bank notes, include the following steps: inputting value documents into an input pocket and singling the input value documents; capturing one or several properties of the individual value documents; ascertaining an identifier, in particular a serial number, of the value documents with the help of the captured properties of the value documents; storing the ascertained identifier of the value documents; outputting the value documents into at least one output pocket; and checking whether in the at least one output pocket there are located one or several second value documents whose identifier was not ascertained and/or not stored, with the help of the ascertained identifier of one or several first value documents output to the output pocket. The invention enables in an easy and time-saving manner a
(Continued)

reliable processing of value documents, in particular a reliable accounting of deposits.

13 Claims, 2 Drawing Sheets

(51) Int. Cl.

| | |
|---|---|
| ***G07D 11/34*** | (2019.01) |
| ***G07D 11/36*** | (2019.01) |
| ***G07D 11/50*** | (2019.01) |
| ***G07D 11/237*** | (2019.01) |
| ***G07D 11/235*** | (2019.01) |
| ***B42D 25/29*** | (2014.01) |

(52) U.S. Cl.
CPC ..... *G07D 11/237* (2019.01); *G07D 11/30* (2019.01); *G07D 11/32* (2019.01); *G07D 11/34* (2019.01); *G07D 11/36* (2019.01)

(58) Field of Classification Search
CPC ..... G07D 11/0069; G07D 11/0072; G07D 11/0075; G07D 11/20; G07D 11/24; G07D 11/25; G07D 11/26; G07D 11/30; G07D 11/32; G07D 11/34; G07D 11/36; G07D 11/235; G07D 11/237; B65H 2701/1912; B65H 2301/4314; B42D 25/29
USPC ..... 194/206, 207; 209/534; 235/379
See application file for complete search history.

(56) References Cited

U.S. PATENT DOCUMENTS

| | | | | |
|---|---|---|---|---|
| 8,644,585 | B1 | 2/2014 | Mennie et al. | |
| 8,794,510 | B2 | 8/2014 | Buchmann et al. | |
| 8,824,771 | B2 | 9/2014 | Klein | |
| 9,033,130 | B2 | 5/2015 | Saiki | |
| 9,123,192 | B2 | 9/2015 | Buntscheck et al. | |
| 9,245,401 | B2 | 1/2016 | Nishino et al. | |
| 9,284,156 | B2 | 3/2016 | Sakoguchi et al. | |
| 9,355,295 | B1 * | 5/2016 | Jones | G07F 19/20 |
| 2003/0015395 | A1 * | 1/2003 | Hallowell | G07D 7/00 194/206 |
| 2003/0062242 | A1 * | 4/2003 | Hallowell | G07F 19/20 194/302 |
| 2004/0225407 | A1 * | 11/2004 | Kunz | G07D 7/00 700/213 |
| 2005/0150740 | A1 * | 7/2005 | Finkenzeller | G07F 1/06 194/207 |
| 2009/0001157 | A1 | 1/2009 | Buntscheck et al. | |
| 2010/0006482 | A1 * | 1/2010 | Koga | G07D 11/40 209/534 |
| 2010/0032351 | A1 * | 2/2010 | Schmidt | G07D 11/28 209/534 |
| 2012/0197433 | A1 * | 8/2012 | Buchmann | G07D 11/006 700/224 |
| 2012/0235351 | A1 | 9/2012 | Sakoguchi et al. | |
| 2013/0108142 | A1 | 5/2013 | Klein | |
| 2014/0008858 | A1 | 1/2014 | Sakoguchi et al. | |
| 2014/0166432 | A1 | 6/2014 | Saiki | |
| 2014/0202936 | A1 * | 7/2014 | Dopfer | B07C 5/00 209/534 |
| 2015/0161840 | A1 | 6/2015 | Nishino et al. | |
| 2016/0189464 | A1 * | 6/2016 | Mizushima | G06K 9/18 700/232 |

FOREIGN PATENT DOCUMENTS

| | | | |
|---|---|---|---|
| CN | 203133996 | U | 8/2013 |
| DE | 10163267 | A1 | 7/2003 |
| DE | 102004049209 | A1 | 4/2006 |
| DE | 102009044881 | A1 | 6/2011 |
| EP | 1730707 | A2 | 12/2006 |
| EP | 2693410 | A1 | 2/2014 |
| JP | 2012203703 | A | 10/2012 |
| JP | 2013114398 | A | 6/2013 |
| JP | 2014002508 | A | 1/2014 |
| RU | 2276450 | C2 | 5/2006 |
| RU | 2491640 | C2 | 8/2013 |

OTHER PUBLICATIONS

International Preliminary Report on Patentability for corresponding International PCT Application No. PCT/EP2015/000332, dated Aug. 16, 2016.
International Search Report for corresponding International PCT Application No. PCT/EP2015/000332, dated Apr. 15, 2015.
Chinese Office Action from CN Application No. 201580004449.8, dated May 2, 2018.
Chinese Search Report from CN Application No. 201580004449.8, dated Apr. 23, 2018.
Russian Office Action from RU Application No. 2016136381/08(057125), dated Jul. 19, 2018.
Indian Search Report from Indian Application No. 201637021462, dated Jan. 18, 2019.

* cited by examiner

METHOD AND SYSTEM FOR PROCESSING VALUE DOCUMENTS

BACKGROUND

The invention relates to a method and a corresponding system for processing value documents, in particular bank notes, according to the independent claims.

In bank note processing systems, bank notes are checked for different properties, as for example denomination, authenticity and state, and are treated differently depending on the result of the check. Bank notes classified as authentic upon the check are again put into circulation, provided that they simultaneously fulfil certain fitness criteria. Bank notes classified as non-authentic or suspicious, however, are withdrawn from circulation, and soiled, worn or defective bank notes are fed to a shredder for destruction. Further, in bank note processing systems, the respectively fed bank notes may be counted and/or their total value may be ascertained.

In a common application of bank note processing systems, certain amounts of bank notes in the form of so-called deposits are delivered to a bank by a depositor or are fed to a cash center, so as to be accounted automatically there with the help of a bank note processing system, so that the total value can be credited to an account of the depositor.

Upon the automatic processing of bank notes it may occur, e.g. due to disturbances like a jam of bank notes, that individual bank notes are improperly captured and accounted which entails an incorrect credit on the account of the depositor. One possibility for determining such a situation consists in e.g. taking out the bank notes which were output to an output pocket of the bank note processing system and to then manually count them and compare them with a target value. Hence the system may be configured such that for example respectively 100 bank notes are output to an output pocket to subsequently supply these to bundling. When upon the bank note processing in a system configured in this way now non-recognized bank notes are faultily output to the output pocket, this must be determined by a manual counting of all bank notes output to the output pocket, which is very time-consuming because of the high target value of 100 bank notes.

SUMMARY

It is the object of the invention to state a method and a system for processing value documents, in particular bank notes, which makes possible a reliable processing, in particular accounting, of value documents in a simple and time-saving manner.

The method according to the invention for processing value documents, in particular bank notes, has the following steps: inputting value documents into an input pocket and singling the input value documents; capturing one or several properties of the individual value documents; ascertaining an identifier, in particular a serial number, of the value documents with the help of the captured properties of the value documents; storing the ascertained identifier of the value documents; outputting the value documents into at least one output pocket; checking whether one or several second value documents whose identifier was not ascertained and/or not stored are located in the output pocket, with the help of the ascertained identifier of one or several first value documents output to the output pocket.

The system according to the invention for processing value documents, in particular bank notes, has: an input pocket for supplying value documents; a singler for singling the supplied value documents; a sensor device for capturing one or several properties of the individual value documents; a control device for ascertaining an identifier, in particular a serial number, of the value documents with the help of the captured properties of the value documents and for storing the ascertained identifier of the value documents in a memory; a transport device for outputting the value documents into at least one output pocket; a user interface for the output, in particular display, of the ascertained identifier of one or several first value documents output to the output pocket, with the help of the identifier of one or several first value documents output to the output pocket, which identifier was output to the user interface, it being possible to check whether one or several second value documents whose identifiers were not ascertained and/or not stored are located in the output pocket.

The invention is based on the approach to ascertain from each processed value document an identifier with the help of which the value document can be uniquely identified by an operator, and to check with the help of the identifier of one or several processed value documents output to the output pocket, which identifier was output at a user interface, whether improperly processed value documents are possibly located in the output pocket.

In the case of bank notes, such an identifier preferably is the serial number of the respective bank note, which can be obtained for example by means of automatic character recognition from a picture of the bank note. However, alternatively or additionally, it is also possible to ascertain other kinds of identifiers with the help of which the value document to be respectively processed is uniquely identifiable. Hence, such an identifier can be for example an alphanumeric character string and/or a picture of at least a partial region of the value document captured by means of a suitable sensor. The partial region captured by sensor is preferably, in the case of bank notes, a region in which the serial number of the respective bank note is to be expected. The respective picture of this region then normally includes at least a part of the respective serial number, and other parts—for example due to soilings or damages—need not necessarily be readable. In most cases, the picture of this partial region is sufficient, however, to uniquely identify a bank note located in the output pocket as a properly processed bank note with the help of this picture.

The ascertained and stored identifiers of the respective value documents are output at a user interface, in particular in the form of a visual reproduction. With the help of the output identifiers, an operator can obtain information about which of the value documents located in the output pocket were properly recognized and processed, in particular accounted.

If during the processing process errors in the transport of the individual value documents should occur on the way between the input pocket and one of the output pockets, for example due to a jam of the value documents during the transport, it may occur that individual value documents are not properly captured and checked by the sensorics specified in the system, but still are output to an output pocket. Further disturbances may occur, for example, when it comes to malfunctions in a transport device of the system during the transport of the value documents, for example a malfunction of a gate, which leads to a value document being output to a wrong output pocket. With the help of the displayed unique identifier of the properly checked value documents the operator can readily distinguish these from improperly checked value documents, however.

Preferably, the system is configured such that the processing of the value documents is stopped when irregularities in the transport of the value documents occur, as for example in the case of a bank note jam or a transport malfunction. In such a case, the operator can easily check with the help of the value documents most recently output to the output pocket, whether the serial numbers thereof are displayed at the user interface. If this is the case, no unchecked value document was output to the output pocket. If this is not the case, however, it is a value document which was improperly checked and output to the output pocket. This can then be input again into the input pocket to feed it to re-processing.

The invention makes it possible to distinguish improperly processed value document from properly processed value documents in an easy and time-saving manner and to feed the former, where applicable, to a proper re-processing, thereby guaranteeing altogether a reliable processing, in particular accounting, of value documents.

Preferably, with the help of the ascertained identifier of one or several first value documents output to the output pocket the second value documents located in the output pocket whose identifiers were not ascertained and/or not stored are identified or recognized. An identification or recognition within the meaning of the invention is here already given, when it is determined that a bank note located in the output pocket is an improperly processed bank note, for this purpose an operator preferably checks in particular the uppermost value documents of the value document stack located in the output pocket as to whether or not the identifiers thereof, in particular serial numbers, correspond to one of the output, in particular displayed, serial numbers of the properly processed value documents. When not, the value document in question is an improperly processed value document which can be fed to re-processing by inserting it into the input pocket. In this way, ascertaining improperly processed value documents can be effected particularly reliable and fast.

It is further preferred that the identifier of one or several first value documents, which were output to the output pocket and whose identifiers were ascertained and stored, is output at a user interface. The user interface is preferably a display device for visually reproducing the identifiers. Alternatively or additionally, an output of the identifiers can also be effected acoustically, however. With the help of the identifiers of the properly processed value documents output, in particular displayed, by the user interface, these value documents can be distinguished in a reliable and time-saving manner from any improperly processed value documents.

In a further preferred embodiment it may be provided to output the identifier of the first value document, which was output most recently to the output pocket and whose identifier was ascertained and stored, at a user interface. This embodiment is of advantage in particular when the processing of the value documents is stopped automatically or manually, as soon as or shortly after a deviation from the regular processing course was determined, e.g. in case of a jam of value documents along the transport path, a transport malfunction or after a power failure. Automatically stopping the processing can be achieved, for example, in providing suitable sensors, such as for example light barriers along the transport route between the input pocket or singler and the at least one output pocket, which recognize when irregularities in the transport of the value documents occur. On that purpose, there can be monitored whether the value documents are captured within expected points in time or time slots by the light barriers. After a respective stop of the processing, there are normally improperly processed value documents among the uppermost value documents of the value document stacks located in the output pockets. In such a case, any improperly processed value documents can be easily recognized by comparing the identifiers, in particular serial numbers, of the last, normally uppermost value documents of the value document stack located in the output pocket with the identifier of the most recently output and properly processed value document, which identifier is displayed in the user interface. Since the number of uppermost value documents of the stack which come into consideration for such a comparison is normally small and typically between 0 and 3, the time required is very low—compared to counting all value documents of the whole stack.

Preferably, the second value documents located in the output pocket, whose identifiers were not ascertained or not stored, are taken out from the output pocket, input into the input pocket and submitted to processing again. Compared to the manual counting of the value documents located in the output pocket, which is usual in the prior art, the actions to be executed by the operator in this case are considerably easier and less error-prone, which further increases the reliability of the processing of the value documents.

In a further preferred realization an operator is prompted, in particular by a respective output or display by the user interface, to take out the uppermost value document or value documents of the value documents located in the output pocket, until the first value document which was most recently output to the output pocket and whose identifier was ascertained and stored is reached, and to re-input the taken-out uppermost value document or value documents, which correspond to the improperly processed second value documents, into the input pocket or to feed these to processing again. This increases the reliability in recognizing and re-processing, in particular accounting, of improperly processed value documents still further.

Preferably, in addition to the identifier of a value document there is ascertained a value, in particular the face value, of the respective value documents with the help of the captured properties, such as for example the printed image respectively recorded, of the value documents. Here, it can in particular be provided that value documents which are located in the output pocket and whose values could not be ascertained are fed to processing again. This achieves that only the value documents whose identifier and value could have been automatically ascertained are classified as properly processed. The first value documents output to the respective output pocket are then in any case correctly accounted value documents from which any second value documents whose values and/or identifiers were ascertained improperly can be reliably distinguished and can be fed to re-processing including correct accounting.

In further preferred embodiments, the second value documents located in the output pocket whose identifiers and/or values were not ascertained and/or not stored are identified or recognized in a manner according to the invention and preferably fed to re-processing again after at least one of the following cases has occurred: A transport fault and/or a jam of value documents upon processing the supplied value documents was determined, and/or a power failure during upon the processing of the supplied value documents was determined. Determining the respective event is here preferably effected automatically by respective sensors, such as for example light barriers or picture sensors, in the region of the singler, in the region of the output pockets or at certain places of the transport path between the singler and the output pockets. By the invention, the value documents which as a result of such irregularities in the value document processing were not or not completely processed, in particular improperly accounted, and were still output to an output pocket can be ascertained easily and fast and fed to re-processing, so as to guarantee a correct accounting of the respectively input deposit.

BRIEF DESCRIPTION OF THE DRAWINGS

Further features, advantages and application possibilities of the present invention arise from the following description in connection with the Figures, in which.

DETAILED DESCRIPTION OF VARIOUS EMBODIMENTS

Figure 1:
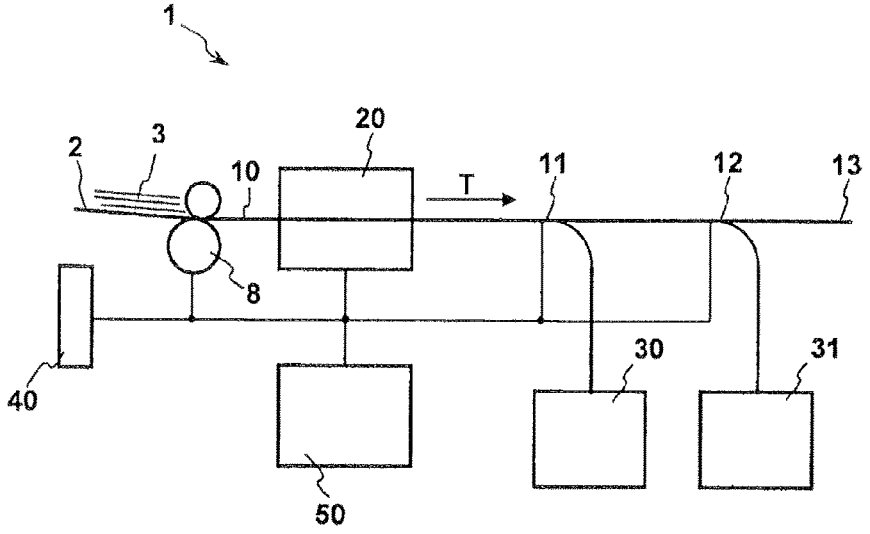
FIG. 1 shows an example of a schematic structure of a value document processing system.

FIG. 1 shows an example of a schematic structure of a value document processing system 1 with an input pocket 2 in which a stack of value documents to be processed, in particular bank notes 3, is supplied, and a singler 8 by which the respective lowest bank note of the input stack is grasped and transferred to a—in the representation chosen only schematically reproduced—transport device 10 which conveys the bank note in the transport direction T to a sensor device 20.

The sensor device 20 serves for capturing physical properties of the bank notes, such as for example the printed image from which properties of the bank notes, such as for example serial number or denomination (i.e. nominal value) can then be derived. Depending on the bank note properties to be ascertained, the sensor device 20 includes different sensors, such as for example UV/VIS/IR optical remission and/or transmission sensors, luminescence sensors, ultrasound sensors, conductivity sensors and/or magnetic sensors.

The sensor signals generated by the sensor device 20 are passed on to a control device 50 for analysis, in which from the respective sensor signals the desired properties of the respective bank note are derived, such as for example serial number, denomination, authenticity, degree of soiling, wear, defects or the presence of foreign objects, as for example adhesive strips.

Depending on the properties ascertained from the respective bank note, the transport device 10 and the gates 11 and 12 along the transport path through the control device 50 are controlled such that the bank note is fed to one of several output pockets 30 and 31 and is stored there.

Preferably, the system 1 is configurable such that an operator can stipulate which bank notes are output to which of the output pockets 30, 31. The system 1 can thus be configured e.g. such that only bank notes recognized as authentic and fulfilling state criteria, so-called fitness criteria, for a re-circulation are output to the first output pocket 30, while bank notes which were recognized as authentic but were classified as no longer fit for circulation when checked for their state are output to the second output pocket 31.

The reference number 13 at the end of the shown transport path indicates that further output pockets and/or other devices, for example for storing or destroying bank notes, can be provided. There can thus be provided a further output pocket (not represented), such as for example a so-called reject pocket, to which all other bank notes, e.g. non-recognized bank notes or bank notes classified as non-authentic or suspicious are output. Moreover, into the reject pocket there are given the bank notes whose processing is not possible in the system 1, e.g. because errors have occurred upon singling by the singler 8. Such errors can be, for example, the removal of more than one bank note, so-called double removals or multiple removals, or oblique removals upon which means the bank note is not transported in parallel with its edges.

The value document processing system 1 further has a user interface 40, by which information about the bank note processing and/or instructions to an operator are output, on the one hand, and data and/or control commands for controlling the bank note processing by an operator can be input, on the other hand.

In special application cases, as for example upon the processing of deposits in commercial banks, at security transport companies or in so-called cash centers, the concept of value document processing systems 1 is often such that this system checks the bank notes of a bank note stack input in the input pocket 2 as to authenticity, ascertains the denomination thereof and calculates therefrom and stores a total value of the input stack.

Figure 2:
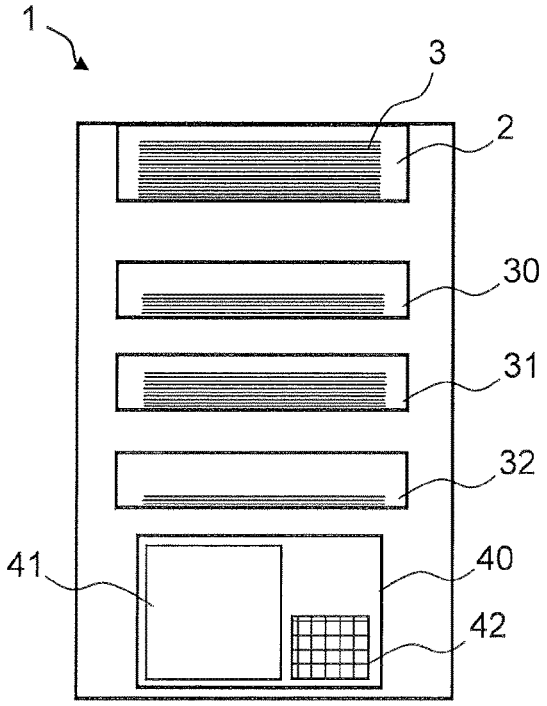
FIG. 2 shows a further example of a value document processing system in a front view.

A value document processing system 1 particularly suitable especially for the fast processing of deposits is represented by way of example in FIG. 2 in a front view. The components of the system, described in connection with FIG. 1, are accommodated in a housing, the input pocket 2 and the output pockets 30 to 32 being disposed in the front region of the housing in such a way that these are easily accessible for an operator, so as to input bank notes 3, in particular in the form of a stack, to the input pocket 2 or to take them out after they have been processed and output to the output pockets 30 to 32.

In the front region of the housing there is further provided a user interface 40 which preferably has a display device 41 for the visual reproduction of information and a keypad 42 for entering data or control commands. The user interface 40 can also be formed by a touchscreen. Alternatively or additionally, it is also possible to arrange the user interface 40 for an acoustic output of information and/or for an input of data or control commands.

The housing of the system 1 may be disposed on a base (not represented), for example on a tabletop which is preferably mounted on height-adjustable legs.

Figure 3:
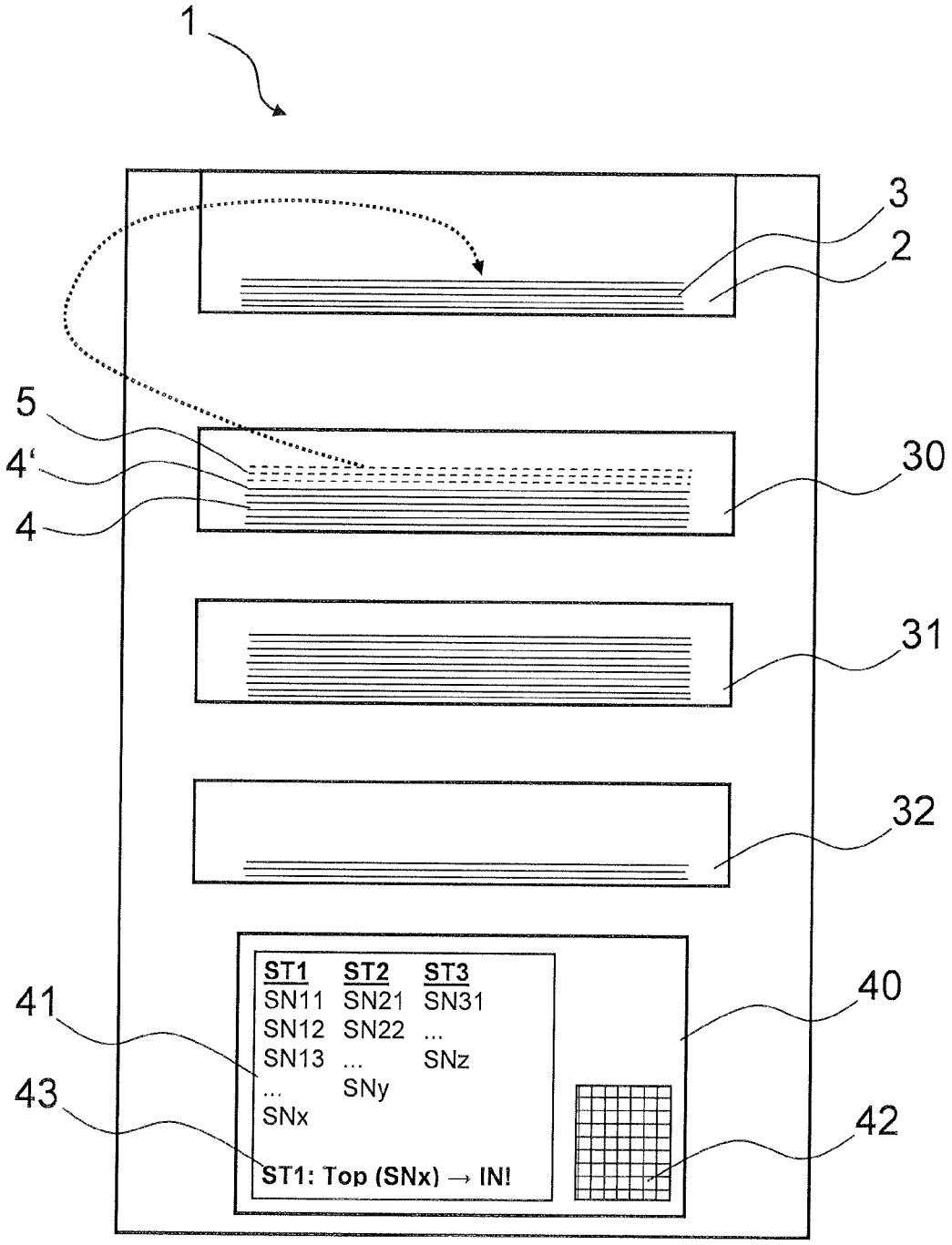
FIG. 3 shows the value document processing system shown in FIG. 2 in a magnified representation.

In FIG. 3 the value document processing system 1 shown in FIG. 2 is represented in a magnified form to illustrate its working method.

In a normal operation of the system 1, the bank notes 3 input into the input pocket 2 by an operator are singly removed from the input pocket 2 and are output, depending on the configuration of the system 1, according to bank note properties respectively captured, to one of the three output pockets 30 to 32 which are also referred to as a stacker. For example, the system 1 may be configured such that to the first output pocket 30 there are output only bank notes classified as authentic and fit for circulation, to the second output pocket 31 bank notes classified as authentic but no longer fit for circulation, and to the third output pocket 32 all the other bank notes.

The display device 41 of the user interface 40 displays the serial numbers SN1 to SNx, SNy or SNz respectively ascertained upon the check of the individual bank notes, preferably in such a way that the order of the displayed serial numbers corresponds to the order of the bank notes output to the respective output pockets 30 to 32. In doing so, preferably, a first order of the bank notes output to the first output pocket 30 is marked accordingly as an order belonging to the first output pocket 30, for example by a corresponding symbol or an alphanumeric character string, such as in the present example "ST1" for the first output pocket 30, "ST2" for the second output pocket 31 and "ST3" for the third output pocket 32. In this way, the operator obtains information about the bank notes properly captured and output to the respective output pocket 30 to 32 and their associated serial numbers SN11-SNx, SN21-SNy or SN31-SNz.

If upon the automatic processing of the input bank notes 3 a deviation from the normal processing procedure occurs, for example a jam of the bank notes transported in the system 1 and the subsequent elimination thereof, or for instance after a temporal power failure, it may occur that one or several bank notes, which were improperly checked and/or accounted in the system 1, are output to at least one of the output pockets 30 to 32.

Such an instance is illustrated by way of example in FIG. 3 by first bank notes 4 (continuous lines), which are located in the first output pocket 30 and were properly captured and processed, as well as by second bank notes 5 (dashed lines) which were improperly captured or processed.

Preferably, the system 1 here is arranged and configured such that it recognizes deviations from the normal processing of the bank notes and thereupon stops this, for example in the case of a jam of the bank notes, by means of the above-described light barriers. Likewise, a transport fault in the transport device 10 may have occurred, e.g. because the gate 11 is defective or was triggered erroneously. Even such a transport fault can be recognized for example by means of the light barriers distributed over the transport device 10. In such a case, the improperly processed second bank notes 5 form the respectively uppermost bank notes of the bank note stack output and located in the first output pocket 30.

With the help of the order of the serial numbers SN11-SNx of the first bank notes 4 properly captured and output to the first output pocket 30, which serial numbers are displayed in the display device 41, an operator can then easily determine, how many or which of the bank notes located in the output bank note stack have been improperly processed. For this purpose, the operator compares, beginning with the uppermost bank note of the output bank note stack, the respective serial number with the serial number SNx which was displayed last in the display device 41 and belongs to the bank note 4' which was properly checked and most recently output to the first output pocket 30. As long as the serial number of the second bank note 5 respectively checked by the operator does not correspond to the displayed serial number SNx of the last properly processed second bank note 4', this is an improperly processed second bank note 5.

Preferably, the second bank notes 5 ascertained in this manner are fed to processing again by the operator, by these being inserted again into the input pocket 2, which is indicated by a dotted arrow in FIG. 3. In addition to the second bank notes 5 ascertained in this manner all the other not yet accounted bank notes, i.e. not already assigned to the first bank notes 4, are inserted into the input pocket 2 by the operator. These can be, for example, the jammed bank notes taken away from the transport device 10 after a jam by the operator.

Preferably, the user interface 40 is arranged such that at the display device 41 there is output, alternatively or additionally to the respective serial numbers, an instruction directed to the operator, by which he is prompted to remove the uppermost bank notes of a bank note stack located in an output pocket up to the most recently output bank note processed properly whose serial number is displayed, and to re-insert these into the input pocket 2. Such an instruction is indicated in the example shown in FIG. 3 by a command line 43 displayed in the display device 41, by which the operator is prompted to insert the uppermost bank notes of the bank note stack, which is located in the first output pocket 30 ("ST1"), up to the bank note with the serial number SNx (not including this bank note) into the input pocket 2 ("IN").

The explanations given by way of example for the first output pocket 30 apply of course also to the improperly processed bank notes which were output to the second or third output pocket 31 or 32. If the second or third output pocket 31 or 32 is operated as a so-called reject pocket to which all the bank notes not recognized upon processing or not processable bank notes (double removal, oblique transport etc.) are output, the bank notes of the reject pocket can be fed to a new check without verification of the serial numbers.

In the case of the embodiment examples explained with the help of the figures, the recognized serial number of the processed bank notes was employed as an identifier. It is evident, however, that other unique features of bank notes can also be employed as an identifier. For example a picture of the bank notes recorded by the sensor device or a part of the picture of the bank notes, e.g. the region of the serial number of the bank notes, is suitable therefor.

The mode of function of the value document processing system 1 and the corresponding method can thus be summarized as follows: By automatically ascertaining a unique identifier, in particular the serial number, of the bank notes the system 1 can exactly retrace which bank note having a certain serial number was properly processed, in particular accounted, and output to a certain output pocket 30 to 32. This information is used, according to the invention, to identify any improperly processed bank notes, for instance after the elimination of a jam, a transport fault or a power failure, and to submit these to re-processing, where applicable. For this purpose, the system 1 preferably instructs the operator to take out the respectively uppermost bank notes of a bank note stack output to an output pocket 30 to 31 up to the last properly processed and accounted bank note whose serial number is captured and displayed, but without removing this last bank note, and to input the bank notes taken out into the input pocket 2 so as to feed these to re-processing in the system 1. The bank notes of the output pocket 32 can be taken out without verifying the serial number and input into the input pocket 2, if the output pocket 32 is a reject pocket.

The particular advantages of this procedure are that normally only few, i.e. typically up to three bank notes must be taken out from the respectively output bank note stack and fed to the input pocket 2 and thus the total number of the bank notes located in the stack has not to be ascertained, like with usual methods in the prior art, which because of the manual counting is time-consuming and error-prone.

The method according to the invention and system 1 is suitable in particular for checking the bank notes output after a power failure or a bank note jam to the output pockets 30 to 32 and makes possible a reliable recognition of possibly non-properly processed bank notes in the respective output pocket 30 to 32 even when the respective serial numbers could not be ascertained completely and, for example, are output only partly at the user interface 40, because the most recently output and properly processed bank note of the stack normally is recognized reliably as such even when its serial number does not correspond to all the digits of the serial number displayed at the user interface 40, e.g. when one or two digits of the serial number are not readable. The invention thus allows altogether a reliable processing, in particular accounting, of the banks notes 3 in a simple and time-saving manner.

The invention claimed is:

1. A method for processing value documents using a value document processing system, comprising the following steps:

a) inputting value documents into an input pocket and singling the input value documents using a singler, b) capturing one or several properties of the individual value documents using a sensor device, c) ascertaining an identifier of the value documents with the help of the captured properties of the value documents using a control device, d) storing the ascertained identifier of the value documents in a memory, e) outputting the value documents into at least one output pocket using a transport device, f) outputting at least one of the ascertained identifiers of the value documents at a user interface and checking whether in the at least one output pocket there are located one or several second value documents whose identifier was not ascertained and/or not stored, with the help of the ascertained identifier of one or several first value documents output to the at least one output pocket, and g) repeating the step f), if several output pockets exist to which value documents were output according to step e);

wherein, in step f), prior to outputting at least one of the ascertained identifiers of the value documents at a user interface and checking whether in the at least one output pocket there are located one or several second value documents whose identifier was not ascertained and/or not stored, detecting an irregularity in the transport of the input value documents using a transportation fault sensor for detecting irregularities in processing, stopping the singling of the input value documents and the capturing of one or several properties of the individual value documents; and wherein the user interface outputs a prompt for an operator to take out the one or more uppermost value documents of the value documents located in the at least one output pocket from the at least one output pocket, until the last first value document whose identifier was ascertained and stored is reached, and re-input the one or more uppermost value documents taken out of the at least one output pocket into the input pocket and feed these to processing again according to the steps a) to e).

2. The method according to claim 1, wherein with the help of the ascertained identifier of one or several first value documents output to the at least one output pocket there are identified the second value documents which are located in the at least one output pocket and whose identifiers were not ascertained and/or not stored.

3. The method according to claim 1, wherein the identifier of one or several first value documents which are output to the at least one output pocket and whose identifiers were ascertained and stored is output at a user interface.

4. The method according to claim 1, wherein the identifier of the last value document of the first value documents which were output to the at least one output pocket and whose identifiers were ascertained and stored is output at a user interface.

5. The method according to claim 1, wherein the second value documents which are located in the at least one output pocket and whose identifiers were not ascertained or not stored are taken out from the at least one output pocket, input into the input pocket and submitted to processing again according to the steps a) to e).

6. The method according to claim 1, wherein in step c), further, a value of the respective value documents is ascertained with the help of the captured properties of the value documents.

7. The method according to claim 6, wherein value documents which are located in the output pocket and whose values were not ascertained are fed to processing again according to the steps a) to e).

8. The method according to claim 1, wherein the second value documents which are located in the at least one output pocket and whose identifiers were not ascertained and/or not stored are fed to processing again according to the steps a) to e), after at least one of the following cases has occurred:

a faulty transport of value documents upon processing the supplied value documents was determined, a jam of value documents upon processing the supplied value documents was determined, or a power failure during upon the processing of the supplied value documents was determined.

9. The method according to claim 1, wherein the outputting of the at least one of the ascertained identifiers is performed acoustically.

10. The method according to claim 1, wherein the transportation fault sensor comprises light barriers along a transport route between the input pocket and the at least one output pocket.

11. A system for processing value documents, comprising:

an input pocket for supplying value documents, a singler for singling the supplied value documents, a sensor device for capturing one or several properties of the individual value documents, a transport fault sensor for detecting irregularities in processing by the system and for stopping the singling of the input value documents and the capturing of one or several properties of the individual value documents;

a control device for ascertaining an identifier of the value documents with the help of the captured properties of the value documents and for storing the ascertained identifier of the value documents in a memory, a transport device for outputting the value documents to at least one output pocket and a user interface for outputting displaying the ascertained identifier of one or several first value documents output to the at least one output pocket, wherein with the help of the identifier of one or several first value documents output to the at least one output pocket, which identifier was output at the user interface, there can be checked, whether one or several second value documents whose identifier was not ascertained and/or not stored is located in the at least one output pocket;

wherein the user interface is adapted to output a prompt directed to an operator to take out the one or more uppermost value documents of the value documents output to the at least one output pocket from the at least one output pocket, until the last first value document whose identifier was ascertained and stored is reached, to re-insert the one or more second value documents taken out from the at least one output pocket into the input pocket and to feed them to processing again, and to output, where applicable, further prompts directed to an operator, if several output pockets exist.

12. The system according to claim 11, wherein with the help of the identifier of one or several first value documents output to at least one output pocket, which identifier was output at the user interface, there can be identified the second value documents which are located in the at least one output pocket and whose identifiers were not ascertained and/or not stored.

13. The system according to claim 11, wherein the user interface is adapted to output the identifier of the last value document of the first value documents which were output to the at least one output pocket and whose identifiers were ascertained and stored.

* * * * *